US011395506B1

(12) United States Patent
Reiber et al.

(10) Patent No.: US 11,395,506 B1
(45) Date of Patent: Jul. 26, 2022

(54) BRIQUETTE AND METHOD OF MANUFACTURING THE SAME

(71) Applicant: PRKS Holdings, LLC, Denver, CO (US)

(72) Inventors: Braden Reiber, Denver, CO (US); Michael Peterson, Denver, CO (US); Jason Santos, Denver, CO (US)

(73) Assignee: PRKS HOLDINGS, LLC, Denver, CO (US)

( * ) Notice: Subject to any disclaimer, the term of this patent is extended or adjusted under 35 U.S.C. 154(b) by 0 days.

(21) Appl. No.: 17/556,960

(22) Filed: Dec. 20, 2021

(51) Int. Cl.

| | |
|---|---|
| ***A24D 1/18*** | (2006.01) |
| ***A24B 3/14*** | (2006.01) |
| ***A24F 5/00*** | (2006.01) |
| ***A24D 1/14*** | (2006.01) |

(52) U.S. Cl.
CPC ..... *A24D 1/18* (2013.01); *A24B 3/14* (2013.01); *A24D 1/14* (2013.01); *A24F 5/00* (2013.01)

(58) Field of Classification Search
CPC .. A24B 13/00; A24B 3/14; A24B 9/00; A24F 5/00–14; A24D 1/14; A24D 1/18
See application file for complete search history.

(56) References Cited

U.S. PATENT DOCUMENTS

| | | | | |
|---|---|---|---|---|
| 2,935,987 | A | 5/1960 | Ackerbauer | |
| 2,937,648 | A | 5/1960 | Meyer | |
| 3,766,929 | A * | 10/1973 | Roman, Sr. | A24D 1/14 131/348 |
| 3,792,704 | A * | 2/1974 | Parker | A24F 5/00 131/183 |
| 3,805,900 | A | 4/1974 | Sainsbury | |
| 2015/0289563 | A1* | 10/2015 | Hood | A24F 1/32 131/222 |
| 2021/0045434 | A1* | 2/2021 | Pandolfino | A24B 15/167 |

FOREIGN PATENT DOCUMENTS

| | | |
|---|---|---|
| CN | 104489897 B | 3/2016 |
| CN | 111436640 A | 7/2020 |

* cited by examiner

*Primary Examiner* — Michael J Felton
*Assistant Examiner* — Yana B Krinker
(74) *Attorney, Agent, or Firm* — Dentons US LLP

(57) ABSTRACT

Disclosed is a *cannabis* briquette formed from compressed *cannabis* and having a hole defining an air channel through the *cannabis* briquette. The hole can enable an inside portion of the *cannabis* briquette to be lit and burned during use. In this way, the *cannabis* briquette can burn outward from the inside portion, which can help to facilitate an even burn of the *cannabis* briquette. The *cannabis* briquette is a pre-bowl configuration, which can be convenient for users because it circumvents any need to grind or compress any *cannabis*, and it is easy to place into a bowl.

28 Claims, 12 Drawing Sheets

600

BRIQUETTE AND METHOD OF MANUFACTURING THE SAME

FIELD OF THE DISCLOSURE

This disclosure relates to *cannabis* products, and more particularly to *cannabis* products that are consumed by inhalation.

BACKGROUND

*Cannabis* products can come in many different forms, including flower, edibles, pills/powder, patches/topicals, and vaping oils. However, *cannabis* products that are consumed by inhalation remain very popular.

A pipe is a filtration device that is commonly used for smoking or inhaling *cannabis*. There are numerous types of pipes used to smoke *cannabis* and other organic products, including water pipes, bongs, hookahs, straight pipes, steam-roller pipes, briar pipes and numerous specialty pipes. The pipe generally includes a bowl to hold the *cannabis* or other substance. *Cannabis* is placed in the bowl and ignited so that smoke from the *cannabis* or other substance can be inhaled.

Unfortunately, it can be cumbersome or inefficient to properly position the *cannabis* in the bowl, the *cannabis* might not stay put in the bowl, the *cannabis* might need to be re-lit for each inhalation, and the *cannabis* often does not burn evenly. Additionally, it can be cumbersome and inefficient to properly pack a bowl with *cannabis*, the user must physically grind the *cannabis*, and the *cannabis* might be packed too tightly or the bowl overladed which can result in difficulty pulling the smoke through the bowl and into the pipe and can clog the hole at the bottom of the bowl. It is desirable to address or mitigate some or all of the aforementioned shortcomings.

SUMMARY OF THE DISCLOSURE

According to an embodiment, there is provided a *cannabis* briquette formed from compressed *cannabis* and having a hole defining an air channel through the *cannabis* briquette. The hole can enable an inside portion of the *cannabis* briquette to be lit and burned during use. In this way, the *cannabis* briquette can burn outward from the inside portion, which can help to facilitate an even burn of the *cannabis* briquette. The *cannabis* briquette is a pre-bowl configuration, e.g., the compressed briquette is pre-formed to fit inside any standard bowl, which can be convenient for users because it circumvents any need to grind or compress any *cannabis*, and it is easy to place into a bowl. The *cannabis* is preferably ground prior to compression. It is understood that the *cannabis* briquette can be formed in any particular shape or size, including but not limited to a round shape, a cube shape, a tablet shape, a disk wafer shape, a fluted cup shape, a cupcake shape, etc.

According to another embodiment, there is provided a *cannabis* briquette formed from compressed *cannabis* and having a defined bulk density that balances structural durability of the *cannabis* briquette with burn capability of the compressed *cannabis* during use, and wherein the defined bulk density of the compressed *cannabis* is between 0.1 $g/cm^3$ to 1.5 $g/cm^3$.

According to another embodiment, there is provided a *cannabis* briquette formed from compressed *cannabis*, such that at least a portion of the *cannabis* briquette has a conical frustum shape configured to fit in a bowl, and the *cannabis* briquette has ridges around the conical frustum shape that are configured to grip the bowl. This can help to prevent the *cannabis* briquette from falling out of the bowl.

According to another embodiment, there is provided a combination of a set of at least one *cannabis* briquettes and an apparatus for holding the *cannabis* briquettes. Each *cannabis* briquette is formed from compressed *cannabis*, such that at least a portion of the *cannabis* briquette has a conical frustum shape configured to fit in a bowl. The apparatus has, for each *cannabis* briquette, a recess having a complementary shape to the conical frustum shape of the *cannabis* briquette so as to receive and hold the *cannabis* briquette in a fixed position. Each *cannabis* briquette may also have ridges around the conical frustum shape that are configured to grip the recess of the apparatus. The apparatus may further include blister packaging for protecting the *cannabis* briquette against external factors, such as humidity and contamination for extended periods of time. The blister packaging, which provides moisture barrier properties, may a plastic film or sheet, an aluminum-based laminate film, peel-open lidding foil, etc.

According to another embodiment, there is provided a compression mold for producing any of the *cannabis* briquettes summarized above.

Other aspects and features of the present disclosure will become apparent, to those ordinarily skilled in the art, upon review of the following description of the various embodiments of the disclosure.

BRIEF DESCRIPTION OF THE DRAWINGS

Embodiments will now be described with reference to the attached drawings in which.

DETAILED DESCRIPTION OF EMBODIMENTS

It should be understood at the outset that although illustrative implementations of one or more embodiments of the present disclosure are provided below, the disclosed systems and/or methods may be implemented using any number of techniques. The disclosure should in no way be limited to the illustrative implementations, drawings, and techniques illustrated below, including the exemplary designs and implementations illustrated and described herein, but may be modified within the scope of the appended claims along with their full scope of equivalents.

*Cannabis* Briquette

Figure 1A:
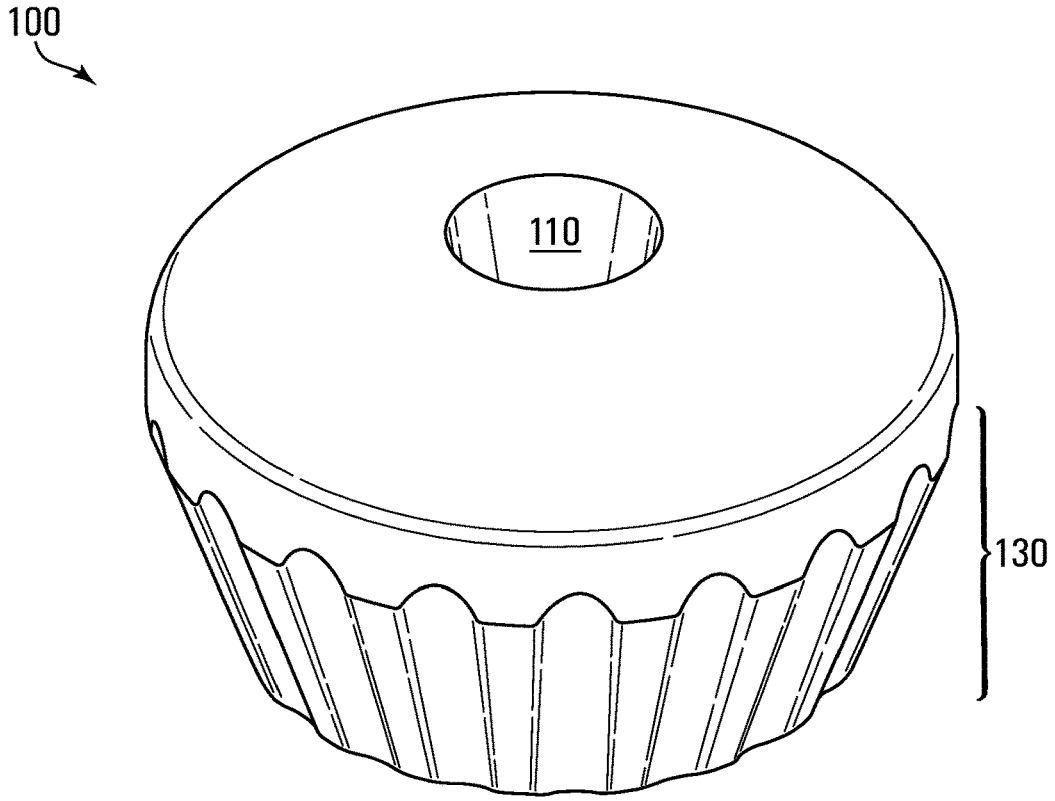
FIGS. 1A and 1B are schematics of a *cannabis* briquette.
Figure 1B:
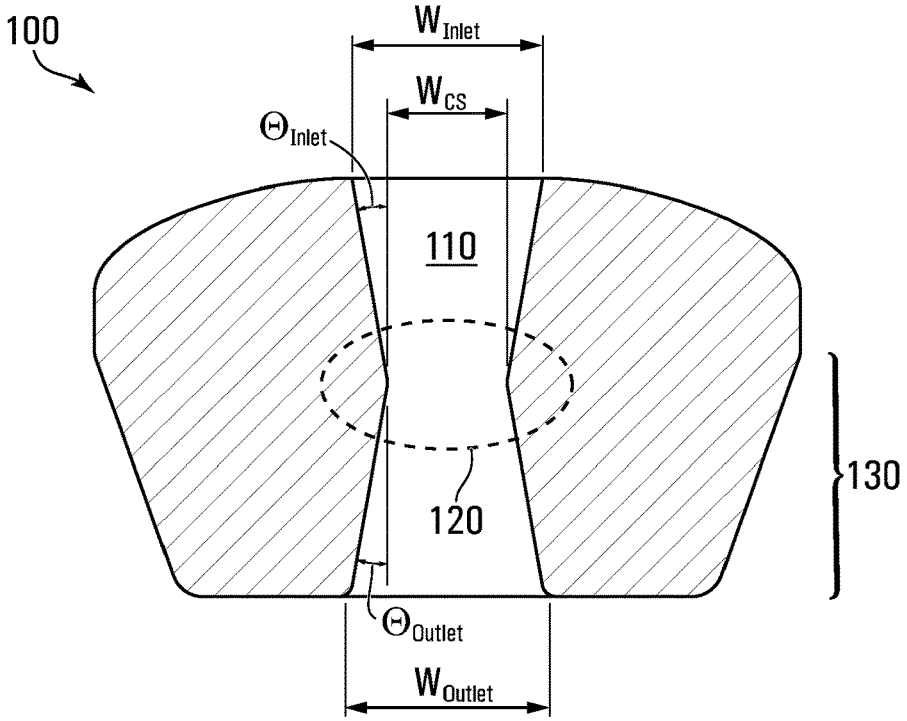

Referring now to FIGS. 1A and 1B, shown are schematics of a *cannabis* briquette 100. The *cannabis* briquette 100 is shown using an isometric view (FIG. 1A) and a cross-section view (FIG. 1B). In accordance with an embodiment of the disclosure, the *cannabis* briquette 100 is formed from compressed *cannabis* and has a hole 110 defining an air channel through the *cannabis* briquette 100. As shown, the air channel traverses vertically from a top portion to a bottom portion of the *cannabis* briquette 100.

The *cannabis* is preferably ground prior to compression. For example, *cannabis* material may include, without limitation, the leaves, flowers, or buds of one or more *cannabis* plants. The flowers or buds have the highest concentration of cannabinoids and terpenes; however, any part or parts of the *cannabis* plant may be processed. The grinding step may use any grinding method or methods, such as hand grinding, machine grinding, or use of a chipper or mulcher. Initial grinding may be followed in one or more embodiments by one or more filtering stages, for example to filter out stems or sticks.

Figure 2:
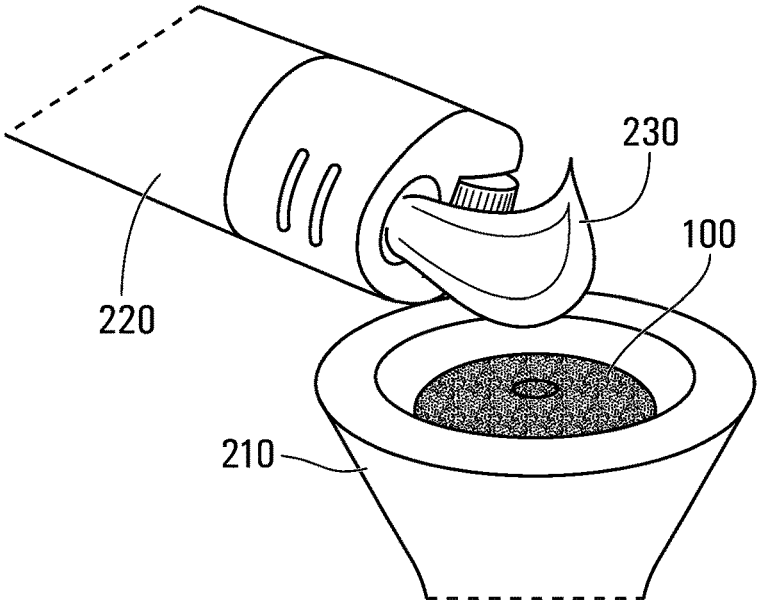
FIG. 2 is a schematic of the *cannabis* briquette being lit while in a bowl.

Referring now to FIG. 2, shown is a schematic of the *cannabis* briquette 100 being lit while in a bowl 210 of a bong. In order to use the *cannabis* briquette 100, the *cannabis* briquette 100 is gently pushed into the bowl 210. In some implementations, a bottom portion 130 of the *cannabis* briquette 100 has a conical frustum shape that fits in the bowl 210. However, other shapes are possible (e.g. sphere shape) and are within the scope of the disclosure. In general, any suitable shape that can fit in bowls can be utilized. The *cannabis* briquette 100 is a pre-bowl configuration, e.g., the compressed briquette is pre-formed to fit inside any standard bowl, which can be convenient for users because it circumvents any need to grind or compress any *cannabis*, it is easy to place into the bowl 210, and it provides for a consistent user experience.

After being positioned in the bowl 210, a lighter 220 (or other flame source) is used to produce a flame and air mixture 230, which can be drawn through the hole 110 of the *cannabis* briquette 100, for example by inhalation by a user through the bong. This process can enable an inside portion of the *cannabis* briquette 100 to be lit and burned during use. In this way, the *cannabis* briquette 100 can burn outward from the inside portion, which can help to facilitate an even burn of the *cannabis* briquette 100. Also, it is possible to have the *cannabis* briquette 100 remain "cherried" during use, which means that it can remain burning thereby avoiding any need for re-lighting it, because of lasting embers in the compressed *cannabis*.

Figure 3:
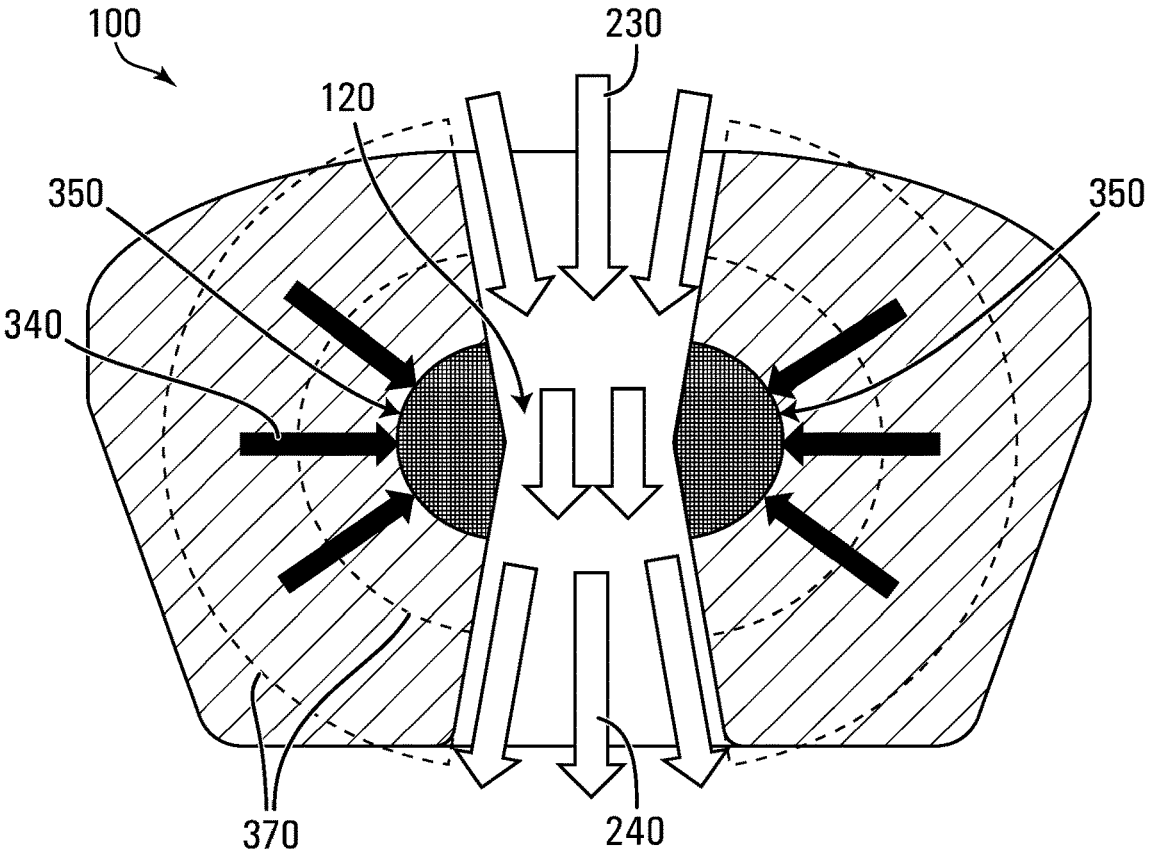
FIG. 3 is a cross-section schematic of the *cannabis* briquette operatively showing a process of being lit for use.

Referring now to FIG. 3, shown is a cross-section schematic of the *cannabis* briquette 100 operatively showing a process of being lit for use. The flame and air mixture 230 is drawn through the hole 110 of the *cannabis* briquette 100, for example by inhalation by a user through the bong. In some implementations, as shown in the illustrated example, the hole 110 is a tapered hole 110, such that the air channel has a constricted section 120 within the *cannabis* briquette 100. When the flame and air mixture 230 is drawn through the tapered hole 110, the compressed *cannabis* ignites at an inside portion 350 in vicinity of the constricted section 120, resulting in a smoke and air mixture 240 that can be inhaled by the user through the bong.

Once the inside portion 350 of the *cannabis* briquette 100 is lit, the *cannabis* briquette 100 can continue to burn outward from the inside portion 350. In particular, the burning can occur along a radial burn propagation 370 as shown, until the entire *cannabis* briquette 100 is burned. Such burning occurs especially whenever the user inhales through the bong thereby drawing new air through the air channel of the *cannabis* briquette 100. This can occur without re-lighting the *cannabis* briquette 100 when the *cannabis* briquette 100 remains "cherried". After the *cannabis* briquette 100 is completely burned, it can be removed from the bowl 210. Although the *cannabis* briquette 100 may be more brittle when completely burned, it should be possible to carefully remove it without any crumbling.

Note that the extent at which the *cannabis* briquette 100 ignites can depend on the lighter 220 itself. A typical BIC™ lighter can produce a flame that reaches a temperature of about 1,977° C. or 3,590.6° F. However, other lighters and other flame sources can vary in terms of temperature of flame produced. The *cannabis* briquette 100 can be configured to be lit using most ignition sources.

In some implementations, the compressed *cannabis* has a defined porosity, such that when the flame and air mixture 230 is drawn through the tapered hole 110, a venturi-effect draws oxygen-rich air 340 from within the compressed *cannabis* towards the constricted section 120 thereby facilitating the compressed *cannabis* to be ignited at the inside portion 350. In particular, the flame and air mixture 230 moves faster in the constricted section 120 of the air channel compared to inlet and outlet sections, which causes a drop in pressure due to the venturi-effect, thereby drawing the oxygen-rich air 340 from within the compressed *cannabis*. This venturi-effect also works when the *cannabis* briquette 100 is "cherried" and no flame is needed for re-lighting the *cannabis* briquette 100 (i.e. arrow 230 can simply be air and not a flame and air mixture). When the oxygen-rich air 340 meets the ignited biomass, it increases the burn rate of the material, enlarging the region radially. The extent at which the venturi-effect causes the oxygen-rich air 340 to be drawn towards the constricted section 120 of the air channel can depend on several factors including (i) a porosity of the compressed *cannabis*, and (ii) dimensions of the tapered hole 110. These factors are discussed below.

Generally speaking, a greater porosity of the compressed *cannabis* can allow more of the oxygen-rich air 340 to be drawn towards the constricted section 120 of the air channel. However, if the compressed *cannabis* is too porous, then the *cannabis* briquette 100 may lack enough density for durability and for long and satisfying burns. In some implementations, the compressed *cannabis* has a defined porosity to suitably balance these considerations. There are many possibilities for the defined porosity. In some implementations, the defined porosity of the compressed *cannabis* is between 10% to 70%. In specific implementations, the defined porosity of the compressed *cannabis* is between 30% to 42%. In very specific implementations, the defined porosity of the compressed *cannabis* is about 36%, in accordance with the following calculation.

$$\%P = (1 - (\text{Bulk Density}/\text{Particle Density})) * 100\%$$

$$\%P = (1 - (0.5937/\sim 0.4375)) * 100\%$$

$$\%P = \sim 35.7\%$$

Other implementations for the defined porosity are possible and are within the scope of the disclosure.

As noted above, the extent at which the venturi-effect causes the oxygen-rich air 340 to be drawn towards the constricted section 120 of the air channel can depend on dimensions of the tapered hole 110. Generally speaking, the dimensions of the tapered hole 110 can be defined so as to provide a suitable reduction of pressure within the *cannabis* briquette 100 during use while also allowing enough air flow so that inhalation by the user is not difficult. Also, if a diameter of the constricted section 120 is too large, the flame and air mixture 230 can pass through the hole 110 without making significant contact with the biomass, resulting in charring of the surface material without deeper ignition and the creation of lasting embers. This could prompt subsequent relighting of the *cannabis* briquette 100 to continue consumption. If, on the other hand, the constricted section 120 is too small or even closed off, an insufficient volume of air and flame will be drawn through the *cannabis* briquette 100, thereby failing to ignite the *cannabis* briquette 100. In this instance, the *cannabis* briquette 100 may only char on the top outer surfaces. This could again prompt subsequent relighting of the *cannabis* briquette 100 or adjustment to the material through the venturi to improve and/or continue consumption.

In some implementations, the dimensions of the tapered hole 110 are defined to suitably balance the considerations described above. With reference back to FIG. 1B, such dimensions can for example include an inlet taper $\Theta_{Inlet}$, an outlet taper $\Theta_{Outlet}$, an inlet diameter $W_{Inlet}$, an outlet diameter $W_{Outlet}$, and a constricted section diameter $W_{CS}$. In some implementations, the inlet taper $\Theta_{Inlet}$ and the outlet taper $\Theta_{Outlet}$ are each between 5° to 25°, the inlet diameter $W_{Inlet}$ and the outlet diameter $W_{Outlet}$ are each between 0.25 mm to 10 mm, and the constricted section diameter $W_{CS}$ is between 0.1 mm to 5 mm. In specific implementations, the inlet taper $\Theta_{Inlet}$ and the outlet taper $\Theta_{Outlet}$ are each between 12° to 18°, the inlet diameter $W_{Inlet}$ and the outlet diameter $W_{Outlet}$ are each between 2.5 mm to 3.5 mm, and the constricted section diameter $W_{CS}$ is between 0.8 mm to 1.2 mm. In very specific implementations, the inlet taper $\Theta_{Inlet}$ and the outlet taper $\Theta_{Outlet}$ are each about 15°, the inlet diameter $W_{Inlet}$ and the outlet diameter $W_{Outlet}$ are each about 3 mm, and the constricted section diameter $W_{CS}$ is about 1 mm. Note that the inlet does not need to correspond exactly with the outlet in terms of dimensions. For example, the inlet taper $\Theta_{Inlet}$ can be greater or smaller than the outlet taper $\Theta_{Outlet}$. Likewise, the inlet diameter $W_{Inlet}$ can be greater or smaller than the outlet diameter $W_{Outlet}$. Other implementations for the dimensions of the tapered hole 110 are possible and are within the scope of the disclosure.

The tapered hole 110 as depicted has a shape that resembles two conical frustums positioned together by their smaller faces to form the constricted section 120. This is a double tapered through-hole design that acts as a venturi tube and valve as described above. However, it is to be understood that other shapes are possible and are within the scope of the disclosure. In general, any suitable shape that provides for a constricted section within the tapered hole can be implemented. For example, instead of a tapered hole resembling two conical frustums, it is possible to implement a tapered hole resembling two square frustums. Also, non-linear tapers are possible, such that inside walls of the hole are not straight but are instead curved. In other implementations, there is no taper at all (e.g. hole has cylindrical shape).

As noted above, in some implementations, the bottom portion 130 of the *cannabis* briquette 100 has a conical frustum shape configured to fit in the bowl 210. In some implementations, such fit is snug enough to mitigate or avoid air flow between the *cannabis* briquette 100 and the bowl 210. In some implementations, as shown in FIG. 1A, the bottom portion 130 has ridges around the conical frustum shape, and the ridges are configured to grip or secure the bowl 210. In particular, the ridges function as crush ribs to provide grip. The crush ribs are protruding features of the *cannabis* briquette 100 that aid in the stability of a press-fit connection with the bowl 210. When the *cannabis* briquette 100 is gently pressed down in the bowl 210, the ridges function to lock the *cannabis* briquette 100 in place. Thus, in some cases, the pipe can be dropped, nudged, bumped, tapped or agitated while the *cannabis* briquette 100 remains firmly in place without dislodging. The ridges are also stylistic to give the *cannabis* briquette 100 an appearance of a cupcake. In some implementations, there are 20 ridges, although more or less ridges are possible. In some implementations, the top portion of the *cannabis* briquette 100 has a dome shape. This further provides the appearance of a cupcake.

The hole 410 of the *cannabis* briquette 100 is shown to be a single hole that traverses vertically through a center portion of the *cannabis* briquette 100. This can help to achieve an even burn outward from the middle region of the *cannabis* briquette 100. However, it is to be understood that other implementations are possible in which multiple holes traverse through the *cannabis* briquette 100. For example, in another implementation, the *cannabis* briquette 100 has a set of three holes (not shown) that traverse through the *cannabis* briquette 100 in a parallel fashion, thereby providing three parallel air channels. For such implementation, an inside region of one or more of the air channels can be lit and burned during use. Note that radial burn propagation would still be possible, but some regions of the *cannabis* briquette 100 may burn sooner than other regions, resulting in a burn that might not be even. Also, it could be cumbersome for a user to try to light all of the holes in an effort to try to achieve an even burn. Other number of holes can be implemented.

In some implementations, the compressed *cannabis* has a defined bulk density that balances structural durability of the *cannabis* briquette with burn capability of the compressed *cannabis* during use. Greater density can increase durability, but too much density can impair burn capability. In some implementations, the defined bulk density of the compressed *cannabis* is between 0.1 g/cm$^3$ to 1.5 g/cm$^3$. In specific implementations, the defined bulk density of the compressed *cannabis* is between 0.5 g/cm$^3$ to 0.7 g/cm$^3$. In very specific implementations, the defined bulk density of the compressed *cannabis* is about 0.6 g/cm$^3$, in accordance with the following calculation of bulk density (BD).

$$BD = \text{Mass}/\text{Volume}$$

$$BD = 0.4375\ \text{g}/0.7369\ \text{cm}^3$$

$$BD = 0.5937\ \text{g/cm}^3$$

Note that this calculation assumes a total mass of *cannabis* grounds of 0.4375 g and a total volume of the compressed briquette being 0.7369 cm$^3$. Other numerical values are possible and hence other implementations for the density are possible and are within the scope of the disclosure.

In some implementations, the defined bulk density of the compressed *cannabis* depends on particle density of *cannabis* grounds. In some implementations, the particle density is between 0.1 g/cm$^3$ to 3.0 g/cm$^3$. In some other implementations, the particle density is between 0.2 g/cm$^3$ to 1.5 g/cm$^3$. In specific implementations, the particle density is between 0.40 g/cm$^3$ to 0.48 g/cm$^3$. In very specific implementations, the particle density is about 0.4375 g/cm$^3$, in accordance with the following calculation of particle density (PD).

$$PD = \text{Mass}/\text{Volume}$$

$$PD = 0.4375\ \text{g}/1.0\ \text{cm}^3$$

$$PD = \sim 0.4375\ \text{g/cm}^3$$

Note that this calculation assumes a total mass of *cannabis* grounds of 0.4375 g and a total volume of *cannabis* grounds being 1.0 $cm^3$. These numbers are based on a particle size of 10.0 μm to 15.0 mm, an aggregate particle size range of 2 mm to 6 mm, and an aspect ratio of 1.0 (i.e. sphere). Other numerical values are possible and hence other implementations for the particle density are possible and are within the scope of the disclosure.

In some implementations, the defined bulk density of the compressed *cannabis* depends on moisture content. Greater moisture content can increase density and durability, but too much moisture content can impair burn capability. In some implementations, the moisture content of the compressed *cannabis* is between 5% to 20%. In specific implementations, the moisture content of the compressed *cannabis* is between 8% to 12%. In very specific implementations, the moisture content of the compressed *cannabis* is about 10%. Other implementations are possible and are within the scope of the disclosure.

In some implementations, the defined bulk density of the compressed *cannabis* is defined so as to achieve a durability of between 50-100. More specifically, according to one implementation, the defined bulk density of the compressed *cannabis* is defined so as to achieve a durability of about 85, in accordance with the following calculation of durability (DU).

$$DU = (\text{Weight after tumbling}/\text{weight before tumbling}) * 100$$

$$DU = 85$$

Note that this calculation assumes about 15% of the *cannabis* briquette 100 crumbles off as a result of the tumble. Other numerical values are possible and hence other implementations for the durability are possible and are within the scope of the disclosure.

There are many possibilities for the compressed *cannabis*. The compressed *cannabis* can for example include sativas, indica, hybrids, hemp, *ruderalis*, or any suitable combination thereof. Different combinations are possible and are within the scope of the disclosure. The compressed *cannabis* can include full flower (whole flower), which is the bud of the plant.

Figure 4A:
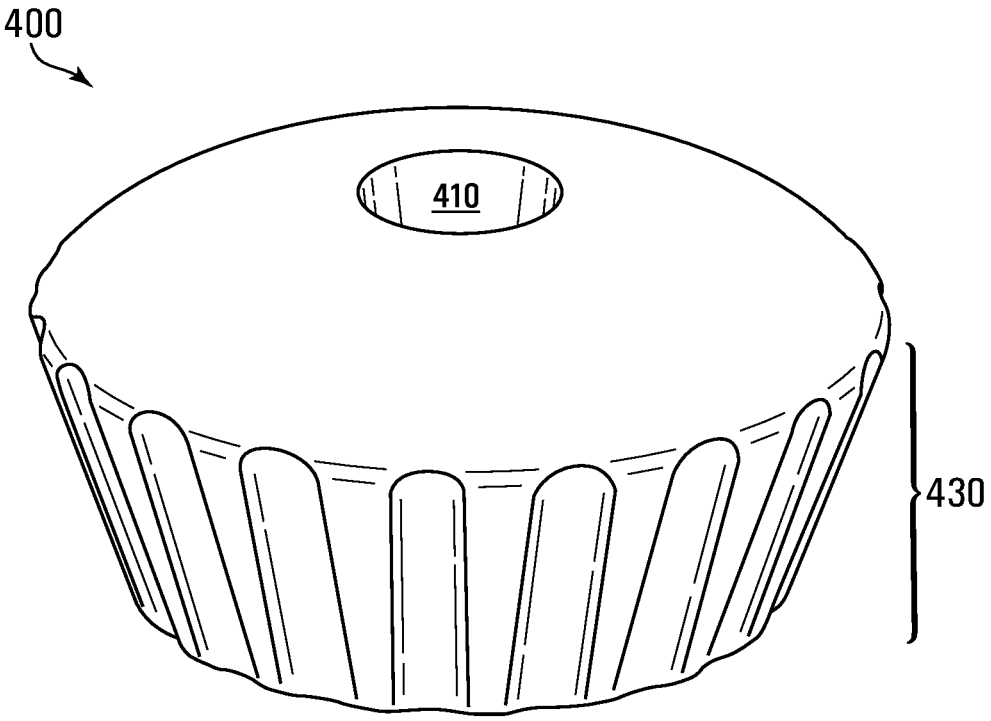
FIGS. 4A and 4B are schematics of another *cannabis* briquette.
Figure 4B:
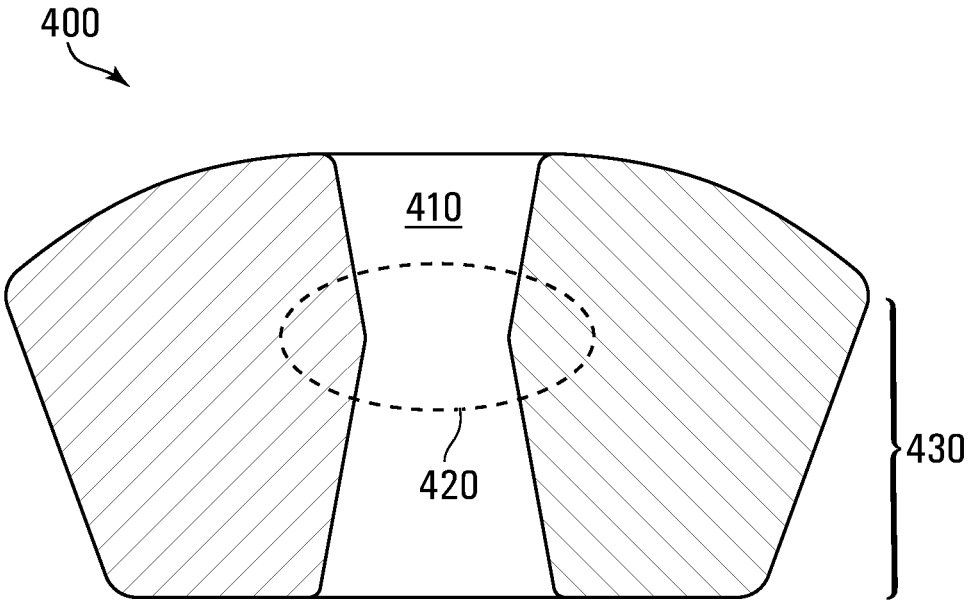

The constricted section 120 of the air channel is shown to be about half way through the air channel in a middle region of the *cannabis* briquette 100. This can help to achieve an even burn outward from the middle region, producing the radial burn propagation 370 as shown. However, it is to be understood that other implementations are possible in which the constricted section 120 is in a top half or in a bottom half of the *cannabis* briquette 100. To illustrate this point, reference is made to FIGS. 4A and 4B, which are schematics of another *cannabis* briquette 400. The *cannabis* briquette 400 is shown using an isometric view (FIG. 4A) and a cross-section view (FIG. 4B). Much like the *cannabis* briquette 100 of FIGS. 1A and 1B, the *cannabis* briquette 400 of FIGS. 4A and 4B has a constricted section 420 within a hole 410 defining an air channel through the *cannabis* briquette 400, and a bottom portion 430 that fits in a bowl. However, the constricted section 420 of the *cannabis* briquette 400 of FIGS. 4A and 4B is in a top half of the *cannabis* briquette 400 instead of in a middle region. Note that radial burn propagation would still be possible, but the top half of the *cannabis* briquette 400 may burn sooner than the bottom half of the *cannabis* briquette 400, resulting in a burn that is not as even.

Figure 5:
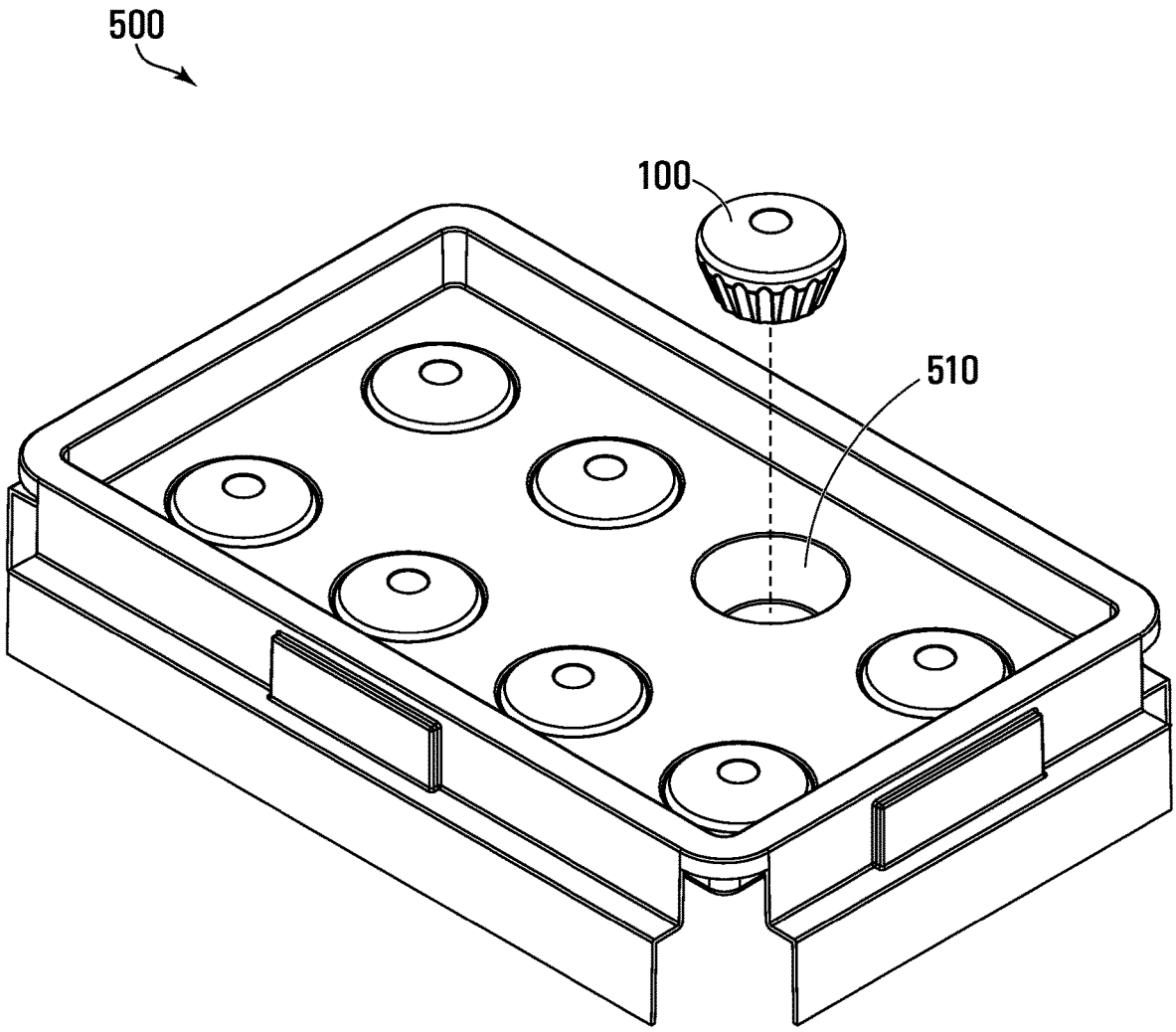
FIG. 5 is a schematic of an apparatus holding a set of *cannabis* briquettes.

Referring now to FIG. 5, shown is a schematic of an apparatus 500 holding a set of *cannabis* briquettes 100. The apparatus 500 has, for each *cannabis* briquette 100, a recess 510 having a complementary shape to the conical frustum shape of the *cannabis* briquette 100 so as to receive and hold the *cannabis* briquette 100 in a fixed position. Furthermore, each *cannabis* briquette 100 has ridges as described above to grip the recess 510 of the apparatus 500. In other words, the same ridges that can grip a bowl can be used to grip the recess 510 of the apparatus 500.

In some implementations, the apparatus 500 is a blister pack 500 as shown. The blister pack 500 can hold several *cannabis* briquettes 100, for example eight *cannabis* briquettes 100, or any other suitable number of *cannabis* briquettes 100. In some implementations, the blister pack 500 is placed within a container (not shown) having a lid. When a user wishes to use a *cannabis* briquettes 100, the lid is opened, a *cannabis* briquettes 100 is removed from the blister pack 500, and then the lid can be closed again. In some implementations, the blister pack 500 and/or the container help to preserve the *cannabis* briquettes 100, by mitigating an extent at which they lose moisture. The blister pack protects the *cannabis* briquette against external factors, such as humidity and contamination for extended periods of time. The blister pack, which provides moisture barrier properties, may a plastic film or sheet, an aluminum-based laminate film, peel-open lidding foil, etc.

The illustrated examples above focus on a *cannabis* briquette having at least one hole. In another embodiment, there is provided a *cannabis* briquette that may or may not have any holes at all. The *cannabis* briquette can otherwise have features similar to those described above. For example, in some implementations, the *cannabis* briquette is formed from compressed *cannabis* and has a defined bulk density that balances structural durability of the *cannabis* briquette with burn capability of the compressed *cannabis* during use, as described above. As another example, in some implementations, the *cannabis* briquette is formed from compressed *cannabis* and a portion of the *cannabis* briquette has a conical frustum shape configured to fit in a bowl, and the *cannabis* briquette has ridges around the conical frustum shape that are configured to grip the bowl, as described above. Other implementations are possible and are within the scope of the disclosure.

Example Compression Mold

Referring now to FIGS. 6A to 6H, shown are schematics of an example compression mold 600 for producing a *cannabis* briquette. It is to be understood that the compression mold 600 is very specific for exemplary purposes and that other compression molds are possible and within the scope of the disclosure.

Figure 6A:
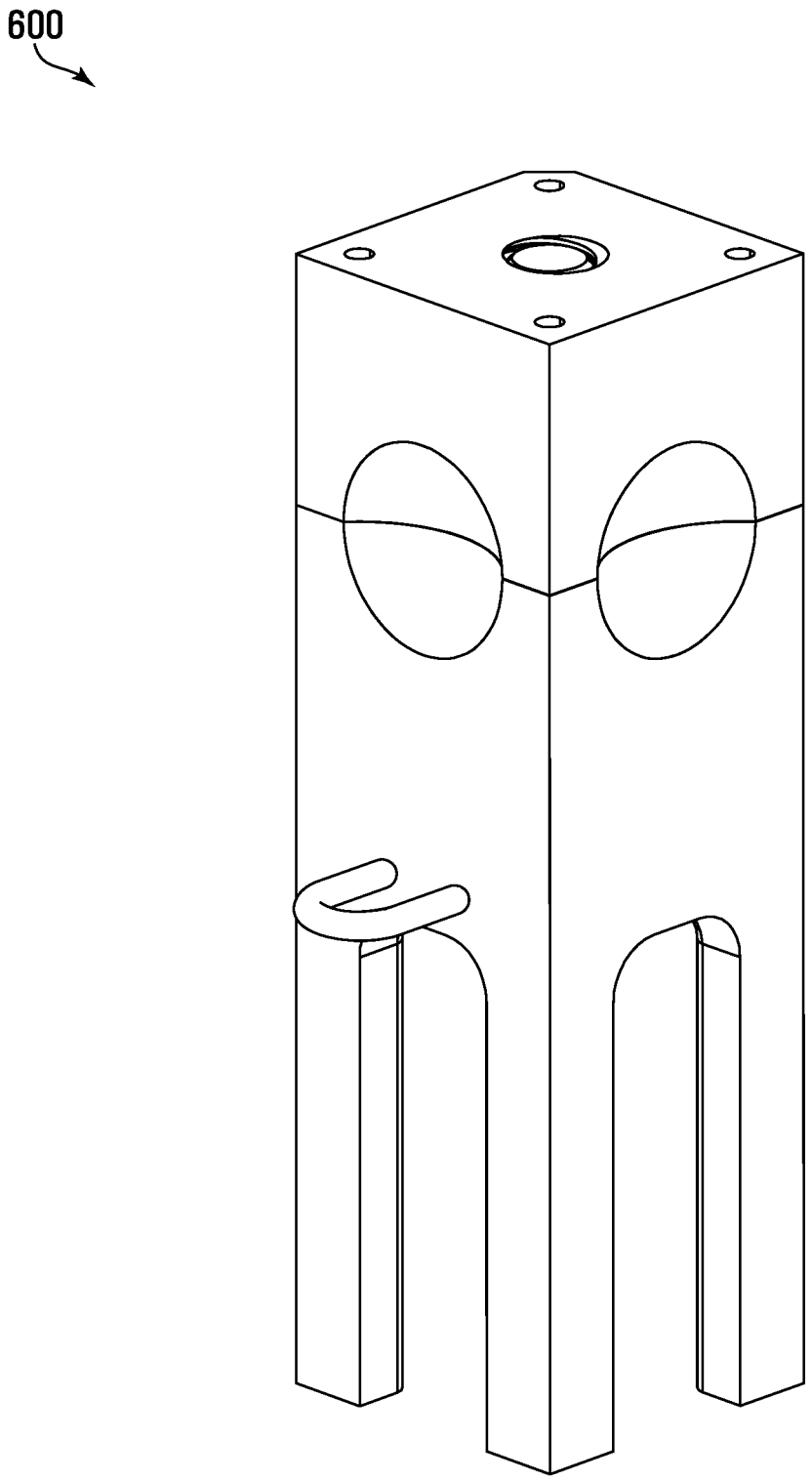
FIGS. 6A to 6H are schematics of an example compression mold for producing a *cannabis* briquette.
Figure 6B:
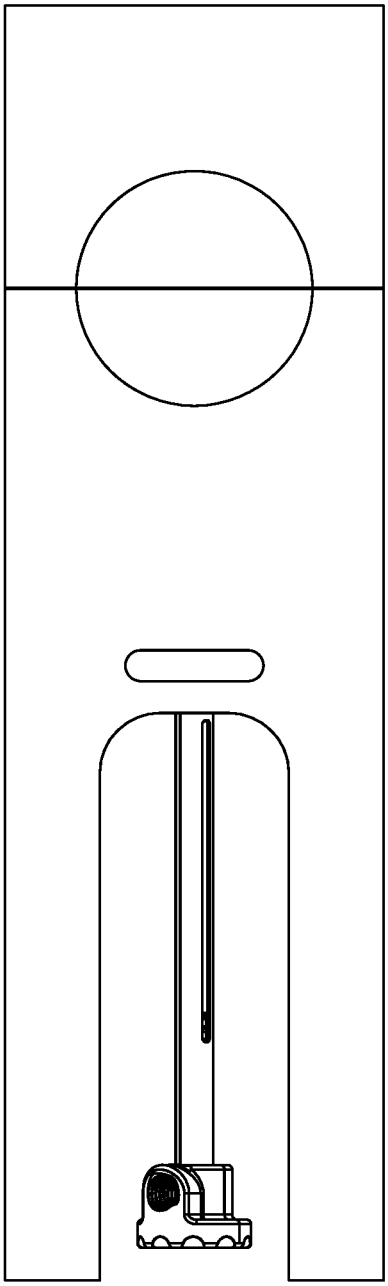

FIGS. 6A and 6B are schematics of the compression mold 600 in a closed state. The compression mold 600 is shown using an isometric view (FIG. 6A) and a front view (FIG. 6B).

Figure 6C:
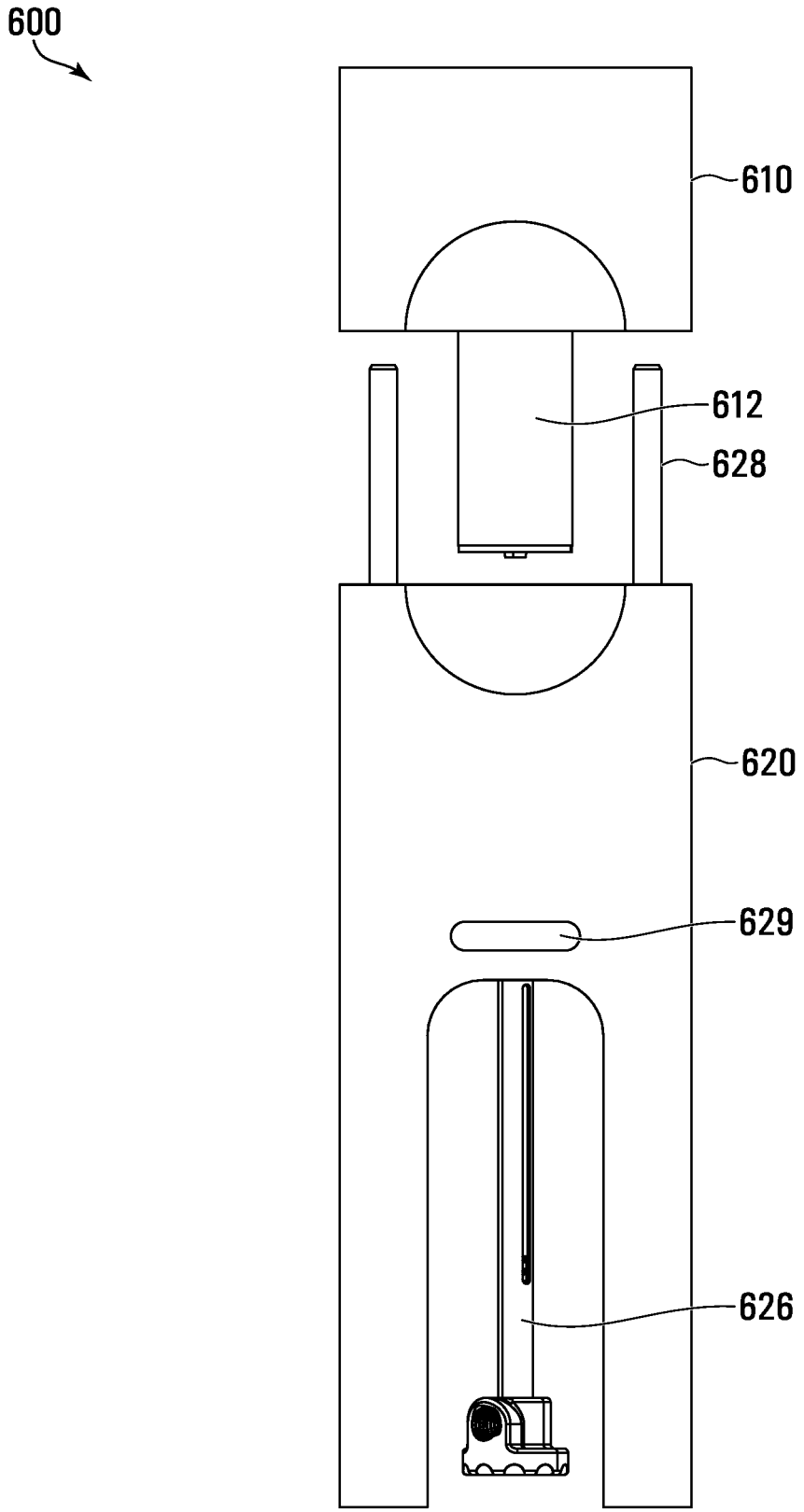
Figure 6D:
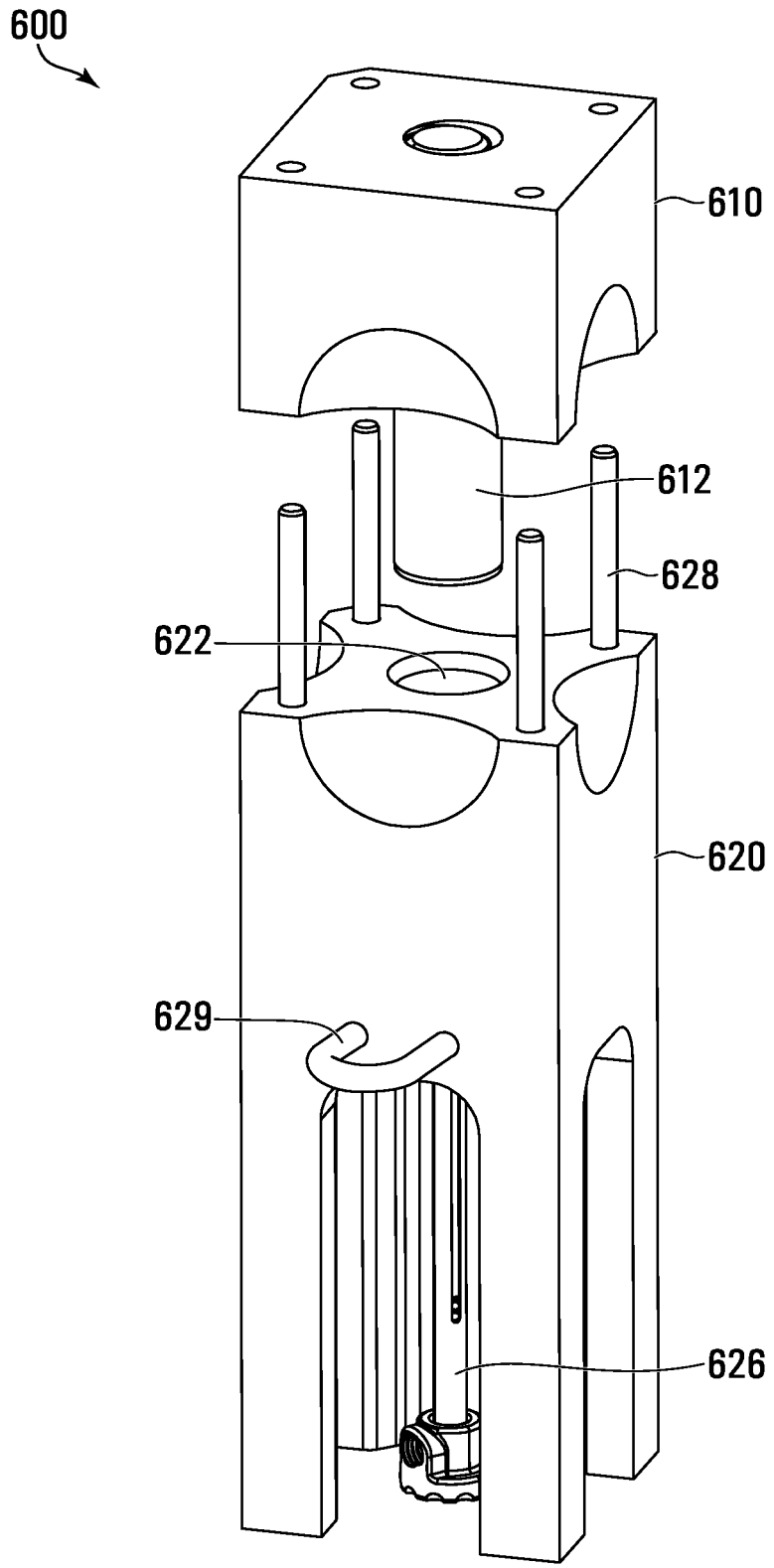

FIGS. 6C and 6D are schematics of the compression mold 600 in an open state. The compression mold 600 is shown using a front view (FIG. 6C) and an isometric view (FIG. 6D).

The compression mold 600 has an upper body 610 having a male plunger 612, and a lower body 620 having a female die chamber 622 that is complementary to the male plunger 612. The compression mold 600 is in the closed state (FIGS. 6A and 6B) when the male plunger 612 of the upper body 610 is inserted into the female die chamber 622 of the lower body 620. Conversely, the compression mold 600 is in the open state (FIGS. 6C and 6D) when the male plunger 612 is not inserted into the female die chamber 622.

In some implementations, the compression mold 600 has guide pins 628 to properly align the upper body 610 and the lower body 620, especially when transitioning from the open state to the closed state. The guide pins 628 are shown to be attached to the lower body 620, but they could instead be attached to the upper body 610 in other implementations.

Figure 6E:
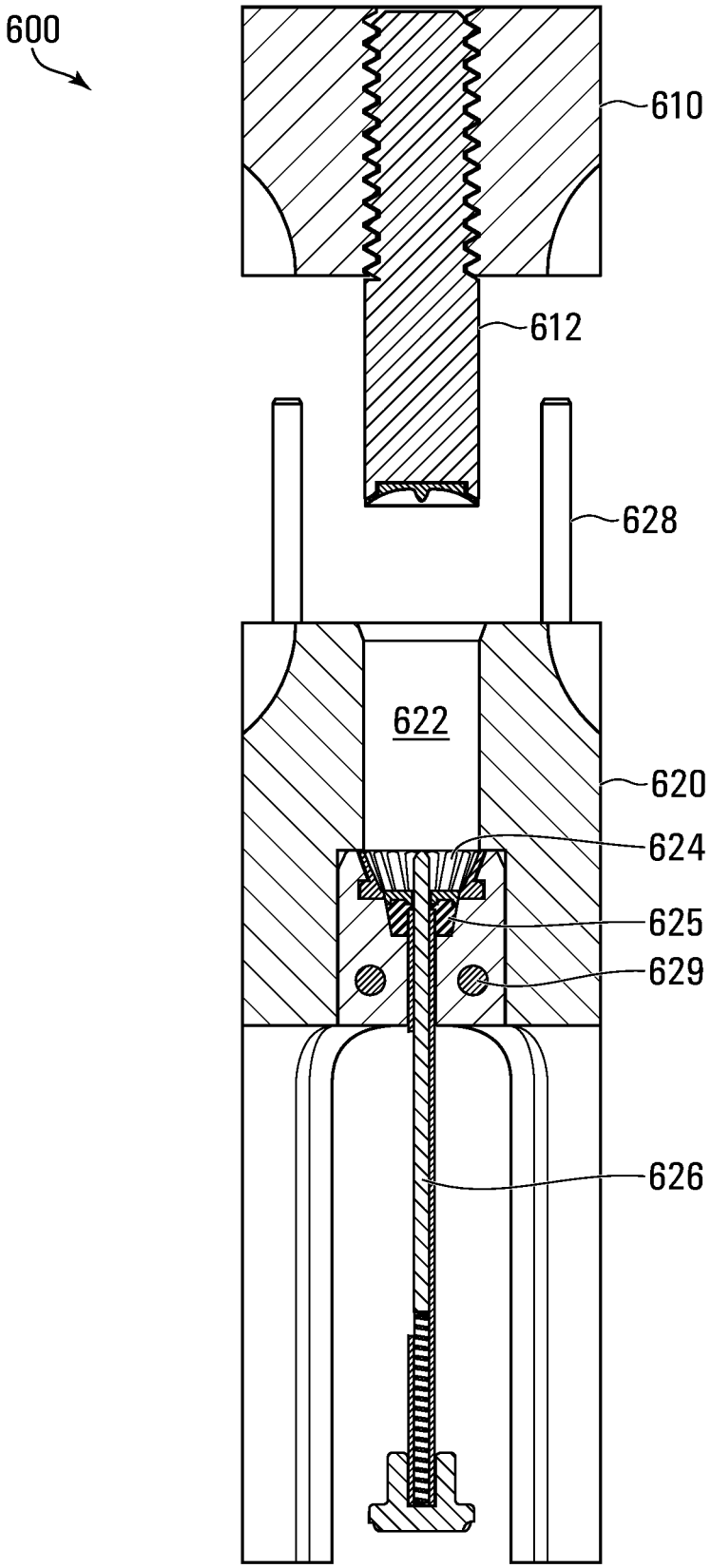
Figure 6F:
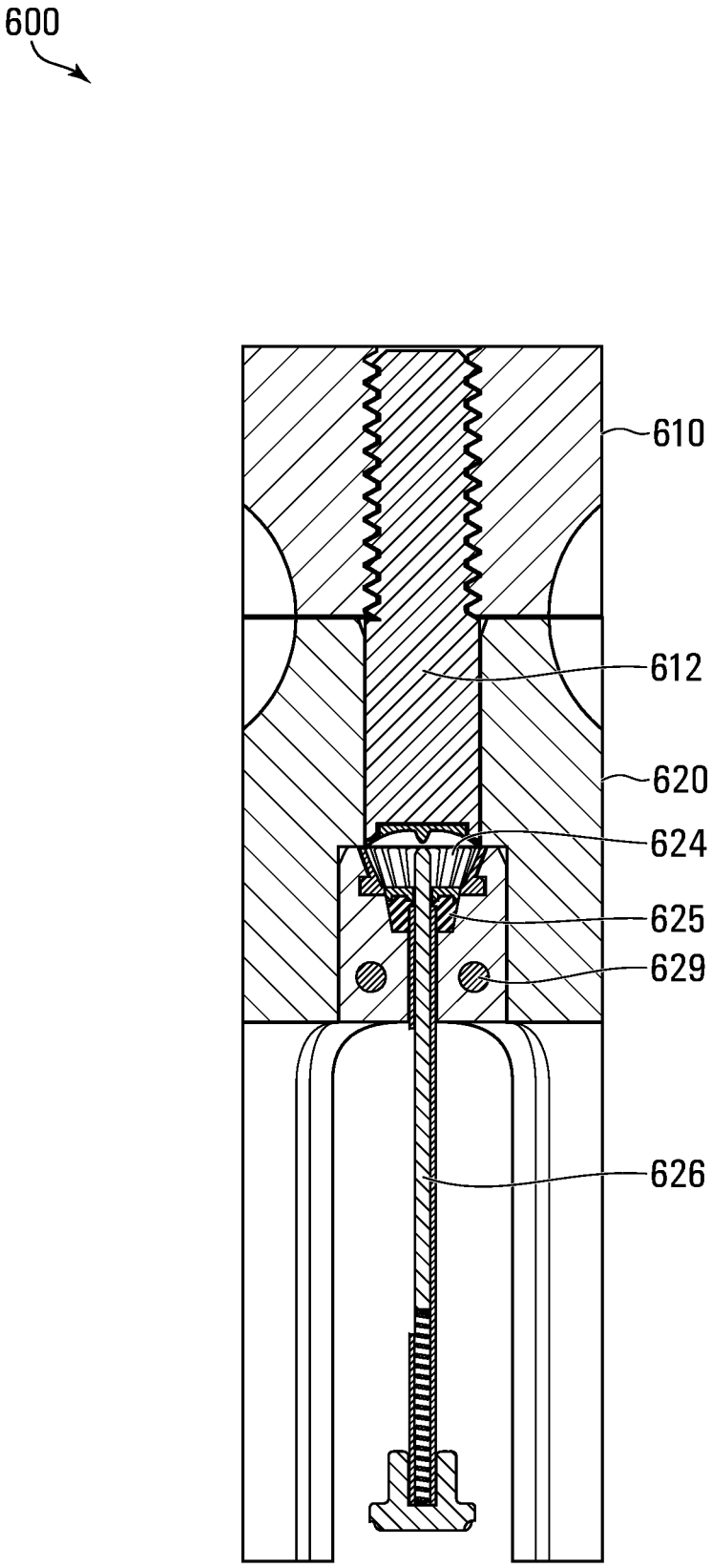

FIGS. 6E and 6F are cross-section views of the compression mold 600. These cross-section views are provided for the open state (FIG. 6E) and the closed state (FIG. 6F). The cross-section views show internal components of the compression mold 600.

During operation, *cannabis* can be placed into the female die chamber 622 while the compression mold 600 is in the open state. Then, the male plunger 612 can be inserted into the female die chamber 622, and forcibly push the upper body 610 and the lower body 620 together in the closed state, thereby compressing the *cannabis* in the female die chamber 622 to form a *cannabis* briquette between the male plunger 612 and a bottom portion of the female die chamber 622.

In some implementations, the bottom portion of the female die chamber 622 is removable and configured such that the *cannabis* briquette tends to stay with the bottom portion during removal of the bottom portion, due to shape and surface area. This enables the *cannabis* briquette to be removed from the female die chamber 622 from the bottom portion.

Figure 6G:
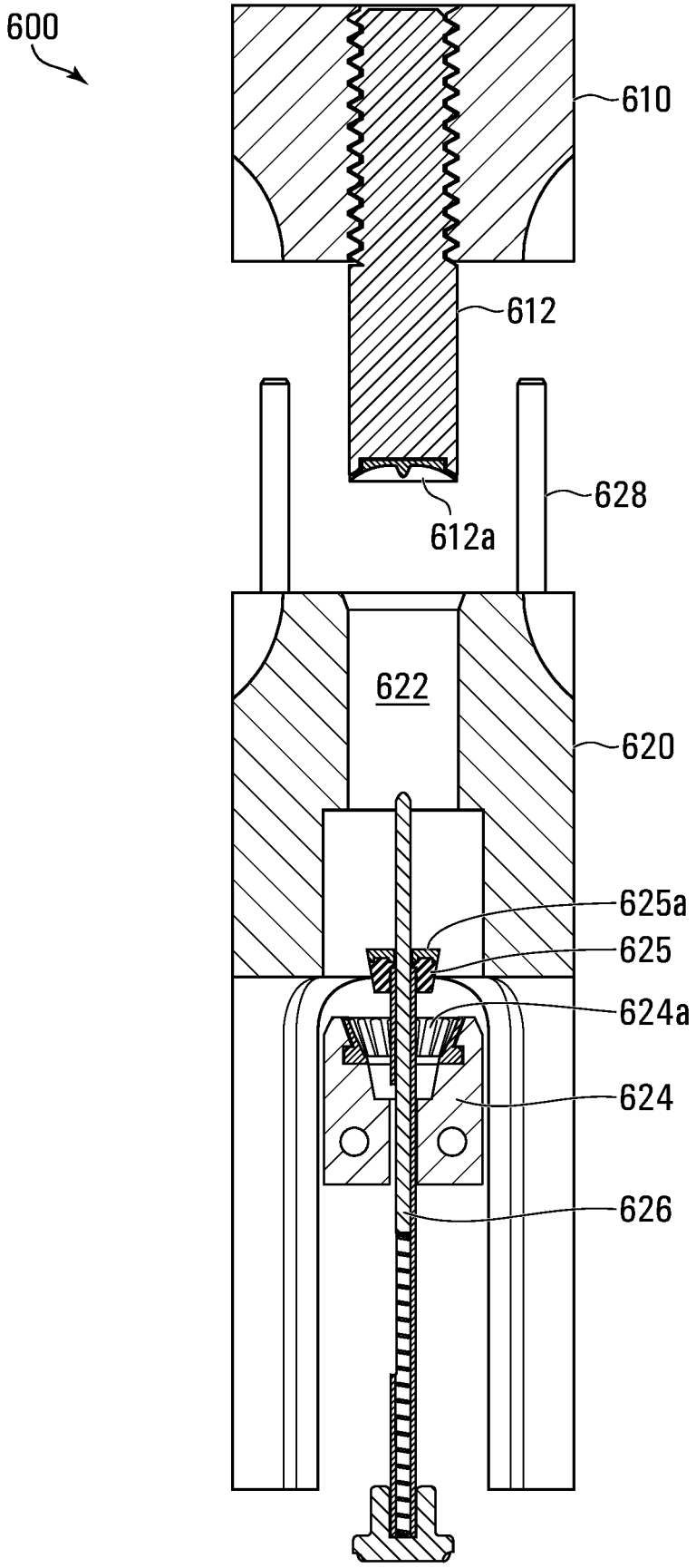
Figure 6H:
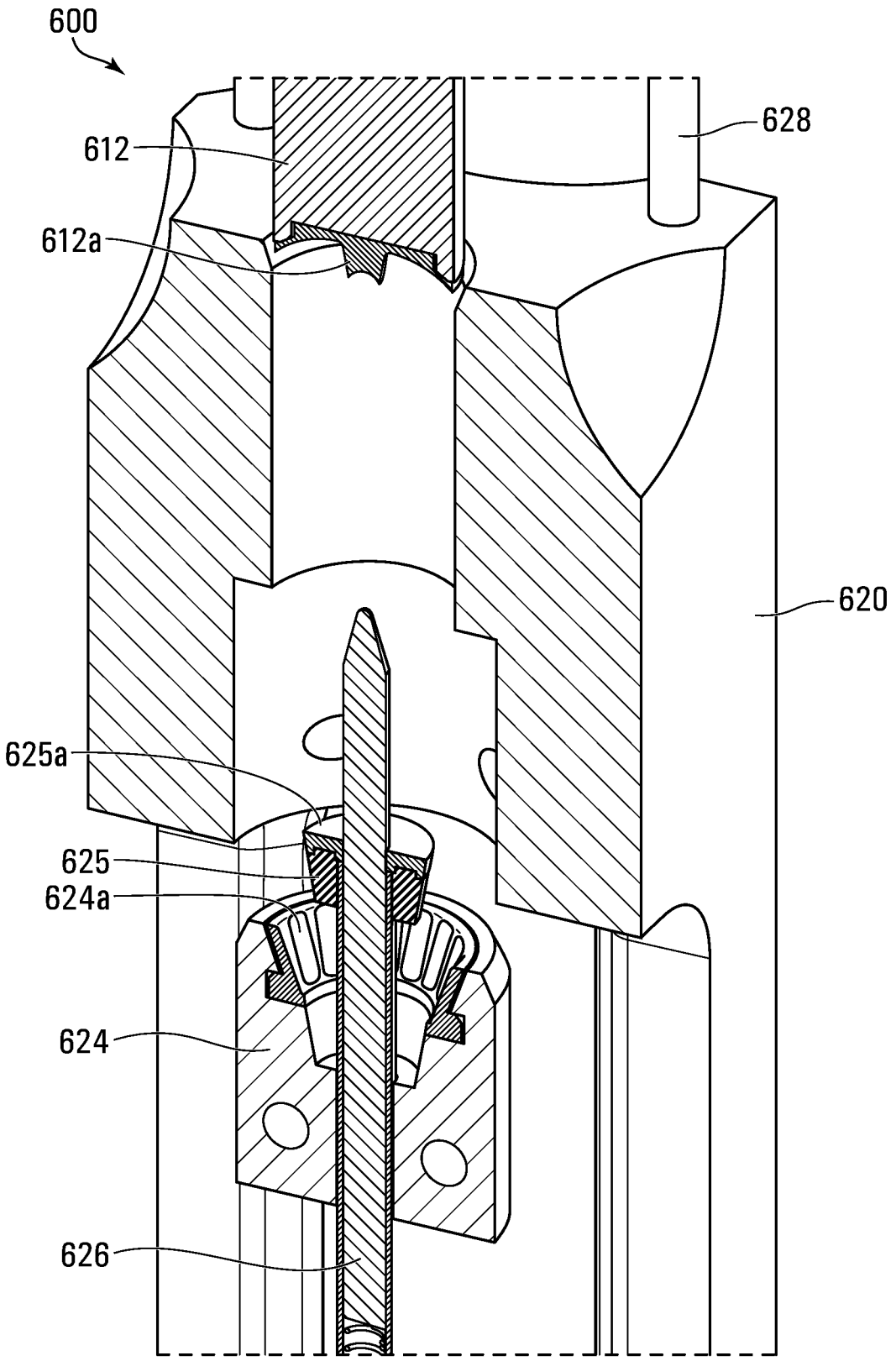

FIGS. 6G and 6H are cross-section views of the compression mold 600. These cross-section views show internal components of the compression mold 600 when the bottom portion of the female die chamber 622 is removed.

In some implementations, the bottom portion of the female die chamber 622 includes a lower slide plug 624, which can be locked in the lower body 620 via a U-shaped locking pin 629. To remove the lower slide plug 624, the U-shaped locking pin 629 is removed from the lower body 620 and then the lower slide plug 624 can be pulled out of the lower body 620.

In some implementations, the bottom portion also includes an ejector platform 625 coupled to an ejector pin assembly 626. The user can pull on the ejector pin assembly 626 to remove the bottom portion from the lower body 620, and then push on the ejector pin assembly 626 while holding the lower slide plug 624 to eject the *cannabis* briquette from the lower slide plug 624.

In some implementations, surfaces used to compress the *cannabis* into the *cannabis* briquette include silicon material. The silicon material can reduce an amount of waste because the compressed *cannabis* does not stick very well to the silicon material. In the illustrated example, the silicon material includes a silicon layer 612*a* for the male plunger 612, a silicon layer 624*a* for the lower slide plug 624, and a silicon layer 625*a* for the ejector platform 625.

In some implementations, the ejector pin assembly 626 includes a pin that traverses through the compressed *cannabis* to form a hole through the *cannabis* briquette. In particular, a tip of the pin connects with a corresponding center portion of the silicon layer 612*a* of the male plunger 612 to form the hole through the *cannabis* briquette. In some implementations, the tip of the pin and the center portion of the silicon layer 612*a* are tapered such that the hole through the *cannabis* briquette is a tapered hole as similarly described in earlier sections.

During operation, the upper body 610 and the lower body 620 are pushed together, such that a compression pressure within the female die chamber 622 can reach between 10 psi-2,000 psi. More specifically, 50 psi-1,000 psi. The amount of compression pressure is implementation specific and can depend on factors such as desired bulk density of the *cannabis* briquette for example. For example, it is understood that an over compressed *cannabis* briquette would have inefficient properties relating to ignition thereof, and an under compressed *cannabis* briquette would have insufficient rigidity to maintain form.

A random close packed density high enough to achieve physical and mechanical properties desired in the *cannabis* briquette cannot be achieved without applying a mechanical load to compress the volume of *cannabis* grounds into a desired rigid shape. Unlike manufacturing methods used in pre-rolled joints, vibration/agitation alone is not enough to achieve a desired result of a stable compacted briquette. This is most likely due to a high degree of polydispersity (irregularity of shape) or high aspect ratio exhibited by individual particles of ground *cannabis*. This keeps the individual ground *cannabis* particles from settling into the desired compact form without additional mechanical compressive load.

The compressive load moves/forces the particles into close proximity, whereby the particle structures mechanically engage in an interlocking configuration that, in part, helps the biomass to retain its shape when the mechanical load is lifted. In addition to mechanical interlocking of the particles due to compaction, trichome structures and terpenes naturally produced on surfaces of the *cannabis* flower are sticky in nature and act as binding agents when the particles are subjected to enough pressure to bring these structures in contact with neighboring particles. These two methods of binding the aggregate ground *cannabis* together are the preferred methods used in the desired embodiment to yield a rigid final shape of the *cannabis* briquette.

Other embodiments may include the addition of natural smokable binding agents such as terpenes, which may be incorporated within the *cannabis* briquette or applied externally to the *cannabis* briquette. Additionally, other embodiments may utilize smoking papers to wrap and encompass the briquette.

Over compaction of the *cannabis* grounds results in a higher bulk density of the briquette that can cause the biomass to become difficult to ignite and subsequently continue to burn. Over compaction can be caused by a number of factors including, but not limited to, compacting force used in production, particle size, particle density, freshness (as it relates to resilience of the *cannabis* grounds), moisture content, trichome count, terpene levels, etc.

It is desirable to achieve a bulk density high enough to allow the briquette of compressed biomass to retain its shape during manufacturing, handling, and distribution of the final product, while at the same time retaining a % porosity in the compressed biomass that is high enough to allow air containing oxygen to reach the ignited material and stoke the burning embers. The desired bulk density and % porosity can allow the ignited material to continue to burn through the compressed volume of the *cannabis* briquette without the need to reignite the biomass briquette.

The cultivation techniques used in *cannabis* production can vary greatly in each grow operation. Factors such as lighting, watering schedule, nutrient control and relative humidity, for example, can all affect the crop, changing the characteristics of the flower even in plants with matching genetics. As a result, the intrinsic properties of the cultivated

*cannabis* flower used in the formation of the briquette can vary significantly, in turn affecting the briquettes viability. Various properties of the *cannabis* grounds including, but not limited to, freshness, moisture content, trichome count, terpene levels, the method of producing the grounds, particle size & aspect ratio, and particle density of individual grounds of *cannabis*, etc., all contribute to the viability of the biomass briquette and the venturi's effectiveness at igniting the biomass.

The freshness and moisture content of the *cannabis* at the time of grinding has a significant impact on the resilience of the plant tissue in the ground particles of *cannabis*. As *cannabis* ages after cultivation the moisture content in the plant tissue begins to drop as water evaporates out of the tissue. This causes the plant tissue to dry out and become brittle over time. When dried, the loss of resiliency will cause the *cannabis* grounds to crumble into particle sizes below the desired range during formation of the compressed briquette. The smaller dried particles can result in a higher bulk density and will in turn stay tightly compacted due to the loss of resiliency. This results in a lower % porosity, making it difficult to ignite the biomass due to the lower volume of oxygenated air passing through the surrounding compacted biomass. In this instance, the higher bulk density of the compacted briquette effectively chokes off the ignited embers starving them of oxygen, thusly, causing the embers to smolder and burn out instead of propagating through the remaining material.

If, on the other hand, the ground particles are too fresh with a high moisture content they will be more resilient to the compaction and will spring back towards their original shape causing the briquette to loft out of its compressed form. The resulting soft briquette will then crumble and fall apart under even the lightest of physical interactions. This results in an unusable briquette. Thus, resilience as it pertains to the compaction of the grounds is a key factor in the briquette's ability to retain the desired shape without becoming over compacted or falling apart.

In addition to the freshness of the plant tissue constituting the grounds, the potency of the *cannabis* is also a contributing factor to the viable production of the compressed biomass briquette. *Cannabis* trichomes and the terpenes they produce are sticky in nature and act as natural binding agents that help to hold the briquette together during formation. *Cannabis* flower grounds with low trichome counts, and therefore lower terpene levels, exhibit far less adhesion during compaction, and often result in soft briquettes that fall apart readily when handled.

Numerous modifications and variations of the present disclosure are possible in light of the above teachings. It is therefore to be understood that within the scope of the appended claims, the disclosure may be practised otherwise than as specifically described herein.

We claim:

1. A *cannabis* briquette formed from compressed *cannabis* and having a hole defining an air channel through the *cannabis* briquette, wherein the hole is a tapered hole such that the air channel has a constricted section within the *cannabis* briquette, and wherein the tapered hole has a shape based on two conical frustums positioned together by their smaller faces to form the constricted section.

2. The *cannabis* briquette of claim 1, wherein the constricted section is in a middle region of the *cannabis* briquette.

3. The *cannabis* briquette of claim 1, wherein the tapered hole is configured such that, when a flame and air mixture is drawn through the tapered hole, the compressed *cannabis* ignites at the constricted section.

4. The *cannabis* briquette of claim 3, wherein the tapered hole has inlet and outlet openings that are each tapered between 5° to 25° towards the constricted section, wherein a diameter at the constricted section is between 0.1 mm to 5 mm, and wherein a diameter at the inlet and outlet openings is between 0.25 mm to 10 mm.

5. The *cannabis* briquette of claim 4, wherein the inlet and outlet openings are each tapered between 12° to 18° towards the constricted section, wherein the diameter at the constricted section is between 0.8 mm to 1.2 mm, and wherein the diameter at the inlet and outlet openings is between 2.5 mm to 3.5 mm.

6. The *cannabis* briquette of claim 3, wherein the compressed *cannabis* has a defined porosity, such that when the flame and air mixture is drawn through the tapered hole, a venturi effect draws oxygen-rich air from within the compressed *cannabis* into the constricted section thereby facilitating the compressed *cannabis* to be ignited around the constricted section.

7. The *cannabis* briquette of claim 6, wherein the defined porosity of the compressed *cannabis* is between 10% to 70%.

8. The *cannabis* briquette of claim 7, wherein the defined porosity of the compressed *cannabis* is between 30% to 42%.

9. The *cannabis* briquette of claim 1, wherein the *cannabis* briquette has a top portion and a bottom portion, such that the hole traverses vertically through the top portion and the bottom portion.

10. The *cannabis* briquette of claim 9, wherein the bottom portion has a conical frustum shape configured to fit in a bowl.

11. The *cannabis* briquette of claim 10, wherein the bottom portion comprises ridges around the conical frustum shape, and the ridges are configured to contact an inner surface of the bowl.

12. The *cannabis* briquette of claim 11, wherein the ridges are configured to grip the inner surface of the bowl.

13. The *cannabis* briquette of claim 1, wherein the compressed *cannabis* has a defined bulk density that balances structural durability of the *cannabis* briquette with burn capability of the compressed *cannabis* during use.

14. The *cannabis* briquette of claim 13, wherein the defined bulk density of the compressed *cannabis* is between 0.1 $g/cm^3$ to 1.5 $g/cm^3$.

15. The *cannabis* briquette of claim 14, wherein the defined bulk density of the compressed *cannabis* is between 0.5 $g/cm^3$ to 0.7 $g/cm^3$.

16. The *cannabis* briquette of claim 13, wherein a moisture content of the compressed *cannabis* is between 5% to 20%.

17. The *cannabis* briquette of claim 16, wherein the moisture content of the compressed *cannabis* is between 8% to 12%.

18. The *cannabis* briquette of claim 1, wherein the hole is a single hole that traverses through a center portion of the *cannabis* briquette.

19. A *cannabis* briquette formed from compressed *cannabis* and having a hole defining an air channel through the *cannabis* briquette, wherein the hole is a tapered hole such that the air channel has a constricted section within the *cannabis* briquette, wherein the tapered hole is configured such that, when a flame and air mixture is drawn through the tapered hole, the compressed *cannabis* ignites at the constricted section, and wherein the tapered hole has inlet and outlet openings that are each tapered between 5° to 25° towards the constricted section, wherein a diameter at the constricted section is between 0.1 mm to 5 mm, and wherein a diameter at the inlet and outlet openings is between 0.25 mm to 10 mm.

20. The *cannabis* briquette of claim 19, wherein the inlet and outlet openings are each tapered between 12° to 18° towards the constricted section, wherein the diameter at the constricted section is between 0.8 mm to 1.2 mm, and wherein the diameter at the inlet and outlet openings is between 2.5 mm to 3.5 mm.

21. The *cannabis* briquette of claim 19, wherein the tapered hole is configured such that, when a flame and air mixture is drawn through the tapered hole, the compressed *cannabis* ignites at the constricted section.

22. The *cannabis* briquette of claim 19, wherein the tapered hole has a shape based on two conical frustums positioned together by their smaller faces to form the constricted section.

23. The *cannabis* briquette of claim 19, wherein the constricted section is in a middle region of the *cannabis* briquette.

24. The *cannabis* briquette of claim 19, wherein the *cannabis* briquette has a top portion and a bottom portion, such that the hole traverses vertically through the top portion and the bottom portion.

25. The *cannabis* briquette of claim 24, wherein the bottom portion has a conical frustum shape configured to fit in a bowl.

26. The *cannabis* briquette of claim 25, wherein the bottom portion comprises ridges around the conical frustum shape, and the ridges are configured to contact an inner surface of the bowl.

27. The *cannabis* briquette of claim 26, wherein the ridges are configured to grip the inner surface of the bowl.

28. The *cannabis* briquette of claim 19, wherein the hole is a single hole that traverses through a center portion of the *cannabis* briquette.

* * * * *